United States Patent [19]

Maeda et al.

[11] 4,128,993

[45] Dec. 12, 1978

[54] ZERO ADJUSTMENT IN AN ELECTRONIC TIMEPIECE

[75] Inventors: Hidetoshi Maeda, Tenri; Mitsuo Morihisa, Nara; Takehiko Sasaki, Yamatokoriyama, all of Japan

[73] Assignee: Sharp Kabushiki Kaisha, Osaka, Japan

[21] Appl. No.: 605,080

[22] Filed: Aug. 15, 1975

[30] Foreign Application Priority Data

Aug. 15, 1974 [JP] Japan ..... 49-94081

[51] Int. Cl.[2] ..... G04C 3/00

[52] U.S. Cl. ..... 58/23 R; 58/85.5

[58] Field of Search ..... 58/85.5, 23 R

[56] References Cited

U.S. PATENT DOCUMENTS

| | | | |
|---|---|---|---|
| 3,889,460 | 6/1975 | Yasukawa et al. | 58/85.5 X |
| 3,942,318 | 3/1976 | Fujita | 58/85.5 |
| 3,967,442 | 7/1976 | Berney | 58/85.5 |

*Primary Examiner*—Ulysses Weldon

*Attorney, Agent, or Firm*—Birch, Stewart, Kolasch & Birch

[57] ABSTRACT

Zero adjustment of second information in an electronic timepiece is carried out upon receiving a command from the operator. "Increment one" is performed upon minute information when the second information is between 24 and 59 seconds when the zero adjustment command is generated. Minute information is not changed when the second information is between 0 and 23 seconds when the zero adjustment command is generated.

2 Claims, 3 Drawing Figures

ZERO ADJUSTMENT IN AN ELECTRONIC TIMEPIECE

BACKGROUND OF THE INVENTION

The present invention relates to zero adjustment in an electronic timepiece such as an electronic digital wristwatch.

The conventional zero adjustment in a mechanical timepiece was performed in the following manner. When the operator depressed a zero adjustment switch at a time when the second-hand was in a region between 0 and 30, the second-hand was forced to rotate fast in a counterclockwise direction to reach the zero second position. When the operator depressed the zero adjustment switch at a time when the second-hand was in a region between 30 and 60, the second-hand was forced to rotate fast in a clockwise direction to reach the zero second position.

Recently, the above-mentioned zero adjustment technique has been applied to an electronic timepiece. An electronic timepiece employing a quartz oscillator has, generally, high accuracy, and the error in a month can be controlled within 15 seconds. Therefore, when the operator performs the zero adjustment once a week with reference to the time tone, the error of the electronic timepiece can be always maintained below several seconds.

The conventional zero adjustment in an electronic timepiece was achieved in a same manner as for the mechanical one. When the second information was in a region between 0 and 30 at a time when a zero adjustment command was generated, a zero adjust control circuit determined that the timepiece was fast and the second information was forced to become zero without changing the minute information. On the contrary, when the second information was in a region between 30 and 60 at a time when the zero adjustment command was generated, the zero adjust control circuit determined that the timepiece was slow and the second information was forced to become zero with an incremental one step of minute calculation.

By the way, in the electronic timepiece which comprises a quartz oscillator of 32,768 KHz and C-MOS circuits, a ratio of tendencies to fast and to slow is not 1:1. Therefore, when the boundary area to increase the minute information is chosen at 30 seconds, there is a considerably great possibility that erroneous time adjustment is achieved. More particularly, increment one is not effected on the minute information at a time when the zero adjustment operation is performed even when the increment is necessary, or the increment operation is performed at a time when it is not required.

OBJECTS AND SUMMARY OF THE INVENTION

Accordingly, an object of the present invention is to provide a zero adjust control circuit for use in conjunction with an electronic timepiece.

Another object of the present invention is to provide a zero adjust control circuit which can perform accurate time adjustment in an electronic timepiece.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications wtihin the spirit and scope of the invention will become apparent to those skilled in the art from this detailed description.

To achieve the above objectives, the present inventors have measured the ratio of tendencies to fast and to slow in an electronic timepiece employing the quartz oscillator. The boundary area to increase the minute information at the zero adjustment operation is determined in accordance with the said measurement.

The electronic timepiece has generally a great tendency to slow that to fast. The error is a month of the electronic timepiece mostly belongs within a region which is to fast 20 seconds and to slow 40 seconds. Therefore, the boundary area to add one to the minute information at the zero adjustment operation is selected below 30 seconds, for example, at 24 seconds.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Referring now in detail to the drawings, and to facilitate a more complete understanding of the present invention, characteristics of a quartz oscillator used in an electronic timepiece of the present invention will be first described with reference to FIG. 1.

Figure 1:
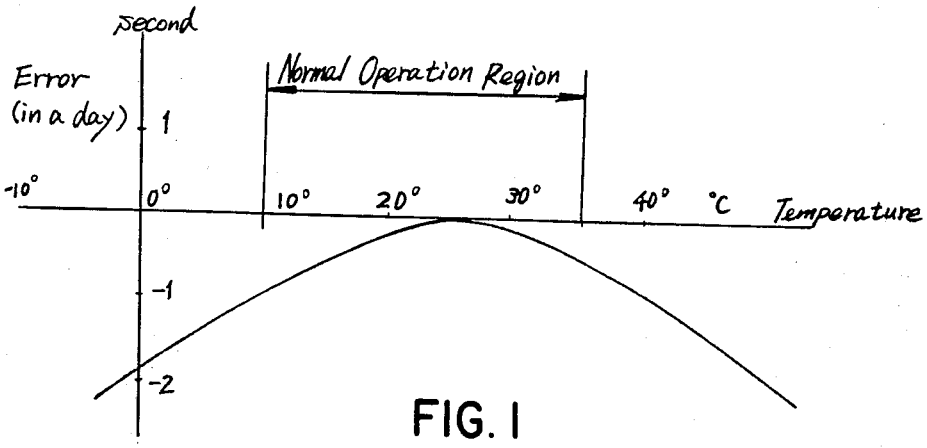
FIG. 1 is a graph showing error versus operation temperature characteristics of a quartz oscillator used in an electronic timepiece.

FIG. 1 shows the relationship between the operation temperature (along the abscissa axis) and the error in a day (along the ordinate axis) of an electronic timepiece employing the quartz oscillator of 32,768 KHz and the C-MOS calculation circuit.

In general, the electronic timepiece such as an electronic wristwatch is used at a temperature between 10° C. and 35° C. The chronometer standard requires that the error becomes zero near 25° C. Therefore, the quartz oscillator used in the electronic timepiece is so controlled that the error becomes zero when used at 25° C. It will be clear from FIG. 1 that the electronic timepiece has a tendency to slow at every temperature except 25° C.

As discussed above the electronic timepiece employing the quartz oscillator has a tendency to slow. But the characteristics of the quartz oscillator may be shifted to fast upon reception of an outer shock. Therefore, there is provided a trimmer condenser to regulate the quartz-crystal oscillation, but it is almost impossible to accurately control the oscillator to make the error zero.

Figure 2:
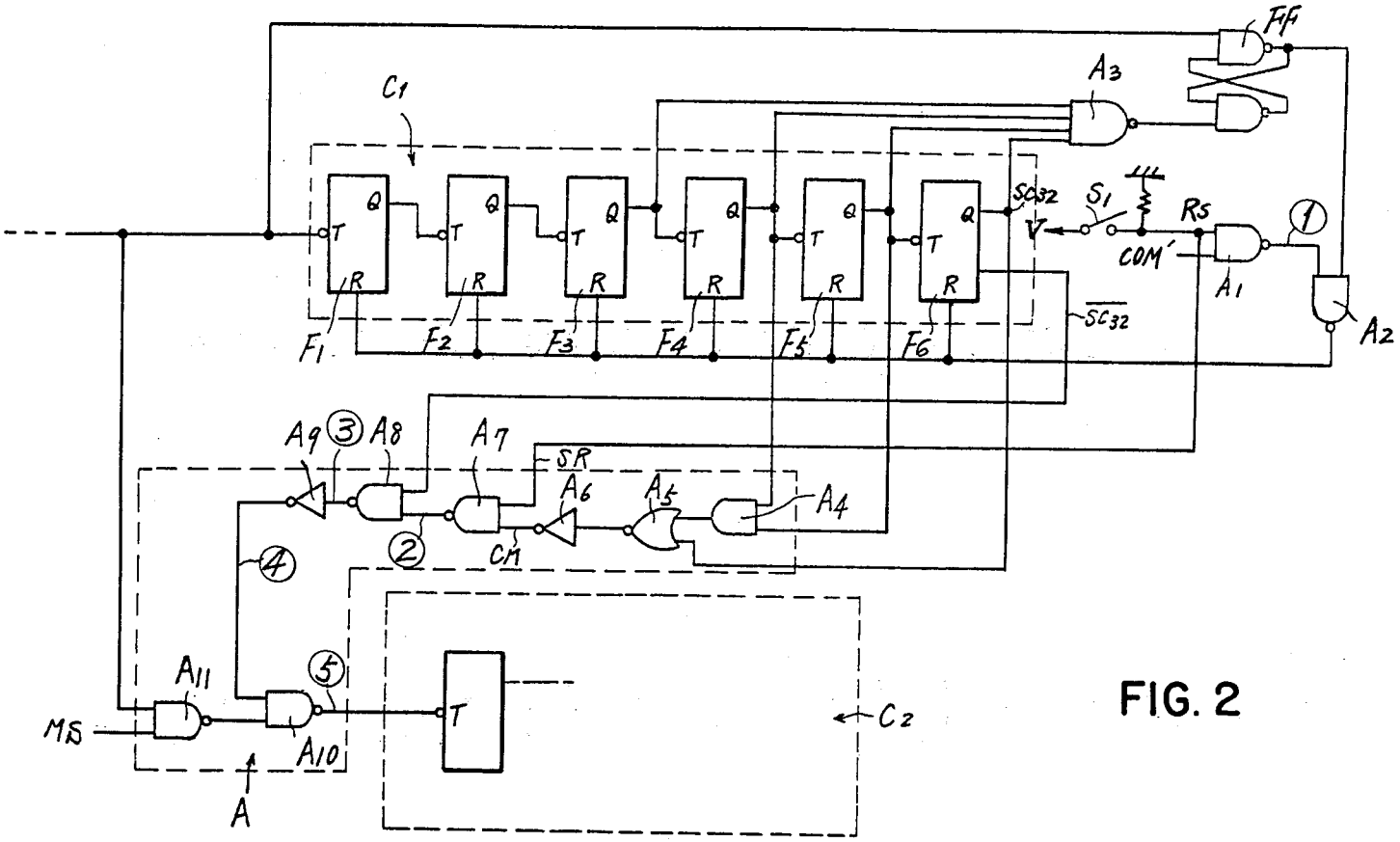
FIG. 2 is a circuit diagram of an embodiment of a zero adjust control circuit of the present invention.
Figure 3:
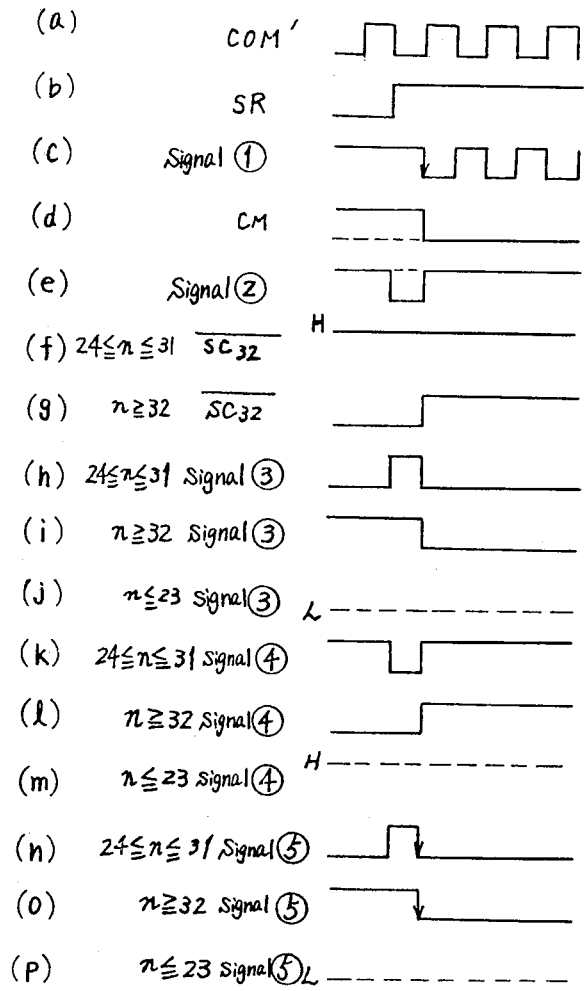
FIG. 3 is a time chart showing wave forms of various signals occurring within the circuit of FIG. 2.

FIG. 2 shows a circuit construction of a zero adjust control circuit of the present invention and FIG. 3 shows wave forms of various signals occurring within the circuit of FIG. 2. In this embodiment, the boundary area to add one to the minute information at a time when the zero adjustment is performed is selected at 24 seconds.

A typical circuit construction of an entire electronic digital wristwatch is shown in Tsutomu Nakamura and Mitsuo Morihisa U.S. Pat. No. 818,484 "POWER SUPPLY CIRCUIT FOR ELECTRONIC DIGITAL SYSTEM" patented on June 18, 1974 and assigned to the same assignee as the present application. Therefore, FIG. 2 only shows an essential part of the circuit of the present invention and the remaining portions have been omitted for the purpose of simplicity.

A second information counter $C_1$ comprises six T-type flip-flops $F_1$, $F_2$, $F_3$, $F_4$, $F_5$ and $F_6$, which are connected in series to form a 1/60 frequency divider. A minute information counter $C_2$ is formed in the same manner as the second information counter $C_1$. The respective output signals of the T-type flip-flops $F_1$–$F_6$ are applied to a display system (not shown) via a decoder (not shown) in a parallel fashion to display the second information or the minute information as is well known in the art. $S_1$ is a zero adjustment command switch, and A is an "increment one" circuit to add one to the minute information at a time when the zero adjustment is performed.

The zero adjustment command switch $S_1$, a NAND gate $A_1$ and another NAND gate $A_2$, from which an output signal is applied to the reset terminals R of the respective T-type flip-flops $F_1$, $F_2$, $F_3$, $F_4$, $F_5$ and $F_6$ of the second information counter $C_1$, form in combination a "forced zero clear" circuit of the second information. A NAND gate $A_3$, of which input terminals are connected to receive output signals Q from the third, fourth, fifth and sixth flip-flops $F_3$, $F_4$, $F_5$ and $F_6$ of the second information counter $C_1$, a flip-flop FF and the NAND gate $A_2$ form in combination an "automatic zero clear" circuit of the second information. When the respective output signals Q of the flip-flops $F_3$, $F_4$, $F_5$ and $F_6$ become the high levels, namely, when the second information counter $C_1$ counts 59 seconds, the "automatic zero clear" circuit functions to reset the flip-flops $F_1$, $F_2$, $F_3$, $F_4$, $F_5$ and $F_6$ and clear the content of the counter $C_1$ to become zero upon receiving the following timing clock.

One input terminal of the NAND gate $A_1$ (a reset terminal RS) is connected to +V volts level via the zero adjustment command switch $S_1$. Another input terminal of the NAND gate $A_1$ is connected to receive a timing signal CON' of which a wave form is shown in FIG. 3(*a*).

When the zero adjustment command switch $S_1$ is depressed, the reset terminal RS of the NAND gate $A_1$ bears the high level and, therefore, the NAND gate $A_1$ provides a signal① as shown in FIG. 3(*c*). The signal① is applied to the NAND gate $A_2$, at which a reset pulse is provided in synchronization with the timing signal COM', whereby the flip-flops $F_1$, $F_2$, $F_3$, $F_4$, $F_5$ and $F_6$ are forced to become zero to clear the second information in the counter $C_1$. A signal SR at the reset terminal RS of the NAND gate $A_1$ is shown in FIG. 3(*b*).

When the zero adjustment command switch $S_1$ is depressed at a time when the second information is between 24 and 59, "increment one" is performed upon the minute information by the "increment one" circuit A in the following manner.

An AND gate $A_4$, a NOR gate $A_5$ and an inverter $A_6$ in combination determine whether the second information in the counter $C_1$ is between 24 and 59. The AND gate $A_4$ connected to receive the output signals Q of the fourth and fifth flip-flops $F_4$ and $F_5$ in the second counter $C_1$ determines whether the second information is between 24 and 31. The inverter $A_6$ provides an output signal CM of the high level when the second information in the counter $C_1$ is greater than or equal to 24, since the NOR gate $A_5$ is connected to receive the output signal of the AND gate $A_4$ and the output signal Q of the sixth flip-flop $F_6$ in the counter $C_1$. FIG. 3(*d*) shows an output wave form CM of the inverter $A_6$. When the zero adjustment command switch $S_1$ is depressed, the output signal CM is forced to become the low level as shown in FIG. 3(*d*) since the respective flip-flops $F_1$–$F_6$ are forced to become zero by the output signal of the NAND gate $A_2$.

NAND gates $A_7$, $A_8$, an inverter $A_9$ and NAND gates $A_{10}$, $A_{11}$ in combination function to provide an increment signal to be applied to the minute counter $C_2$. The NAND gate $A_7$ is connected to receive the output signal CM of the inverter $A_6$ and the reset signal SR associated with the depression of the zero adjustment command switch $S_1$. Therefore, when the zero adjustment command switch $S_1$ is depressed at a time when the second information in the counter $C_1$ is above 24, the NAND gate $A_7$ provides an increment signal② as shown in FIG. 3(*e*). The minute information in the minute counter $C_2$ is "incremented one" by the increment signal②.

The output signal of the sixth flip-flop $F_6$ of the second information counter $C_1$ is applied to one input terminal of the NAND gate $A_8$. The NAND gate $A_8$, the inverter $A_9$ and the NAND gates $A_{10}$, $A_{11}$ in combination provides increment signals⑤ as shown in FIGS. 3(*n*) and 3(*o*) to "add one" to the minute information. An input signal MS for the NAND gate $A_{11}$ is a timing signal for synchronizing the minute counter $C_2$.

FIGS. 3(*f*) and 3(*g*) show wave forms of the $\overline{Q}$ output signal $\overline{SC_{32}}$ of the sixth flip-flop $F_6$ included within the second information counter $C_1$. FIG. 3(*f*) shows the wave form when the zero adjustment command switch $S_1$ is depressed at a time when the second information is between 24 and 31. FIG. 3(*g*) shows the wave form when the zero adjustment command switch $S_1$ is depressed at a time when the second information is greater than 32.

FIGS. 3(*h*), 3(*i*) and 3(*j*) show the output signal③ of the NAND gate $A_8$ when the zero adjustment command switch $S_1$ is depressed at the time when the second information in the counter $C_1$ is between 24 and 31, over 32, and below 23, respectively.

FIGS. 3(*k*), 3(*l*), 3(*m*), 3(*o*) and 3(*p*) show output signals④ and⑤ of the inverter $A_9$ and the NAND gate $A_{10}$ when the zero adjustment command switch $S_1$ is depressed at the time when the second information in the counter $C_1$ is between 24 and 31, above 32, and under 23 respectively.

As described above, in accordance with the embodiment of the present invention, the minute information is "added one" by the trailing edge of the output signal of the NAND gate $A_{10}$ when the zero adjustment command switch $S_1$ is depressed at a time when the second information in the counter $C_1$ is between 24 and 59.

The invention being thus described, it will be obvious that the same way be varied in many ways. Such variations are not to be regarded as a departure from the spirit and scope of the invention, and all such modifications are intended to be included within the scope of the following claims.

What is claimed is:

1. In an electronic time piece which comprises a time information calculation circuit including second and minute counters and a zero adjustment control circuit, the improvement comprising:

a zero adjustment command switch;

a determination circuit responsive to the condition of said second counter of said time information calculation circuit for determining whether in a given 60 second interval of from zero to 59 seconds, the second count has a value between zero seconds and a predetermined value less than 30 second representative of a characteristic boundary between fast and slow error conditions of said timepiece; and an increment signal generation circuit selectively driving said minute counter to increment by one the count therein in response to depression of said zero adjustment command switch coincident with a determination by said determination circuit that said second count is between said characteristic boundary value and 59 seconds.

2. The electronic time piece of claim 1, wherein said timepiece is of the digital quartz oscillator type and said characteristic boundary value between fast and slow error conditions is 23 seconds.

* * * * *